US006153029A

United States Patent [19]

Lin

[11] Patent Number: 6,153,029

[45] Date of Patent: Nov. 28, 2000

[54] PRODUCING OF TAPERED BENT TUBE

[76] Inventor: Wei-Fu Lin, 3F, No. 8, Lane 118, Ming-Teh Rd., Taipei, Taiwan

[21] Appl. No.: 09/141,750

[22] Filed: Aug. 28, 1998

[51] Int. Cl.[7] ..... C21D 9/08; G10D 7/10; B21D 21/00

[52] U.S. Cl. ..... 148/519; 29/890.053; 29/521; 72/368; 84/387 R

[58] Field of Search ..... 29/890.053, 521; 72/368; 148/519; 84/387 R

[56] References Cited

U.S. PATENT DOCUMENTS

| | | | |
|---|---|---|---|
| 4,175,419 | 11/1979 | Mabery | 72/383 |
| 4,830,648 | 5/1989 | Klein et al. | 65/54 |
| 5,405,459 | 4/1995 | Miyamoto et al. | 148/509 |
| 5,412,869 | 5/1995 | Boltz et al. | 29/890.032 |
| 5,855,699 | 1/1999 | Oyama et al. | 148/519 |

*Primary Examiner*—Daniel J. Jenkins
*Assistant Examiner*—Nicole Coy
*Attorney, Agent, or Firm*—Jacobson, Price, Holman & Stern, PLLC

[57] ABSTRACT

A production of tapered bent tube wherein a U-cup with a full opening is pressed to form from a brass plate by a primary mold. The two ends of the full opening of the U-cup are of different calibers. The U-cup is subjected to tempering treatment to eliminate its processing stress. An assembly forming mold is used to punch the fill opening of the U-cup to form a rough shape of tapered bent tube with two different calibers at two ends, and between the two ends with different calibers is a flattened part. The flattened part on the tapered bent tube is removed to form a tapered bent tube; then, the seam of the tapered bent tube is welded and smoothed by roller pressing process, to complete the two ends of different calibers. With aforementioned production method, since the primary mold adopts an expansion approach to form the outside portion of the tapered bent tube, the expansion ratios on the inside and outside of the tapered bent tube can be approximated to avoid cracks, so as to produce a tapered bent tube with a consistent thickness to enable better sound effect.

3 Claims, 6 Drawing Sheets

PRODUCING OF TAPERED BENT TUBE

BACKGROUND OF THE INVENTION

A "production of tapered bent tube", particularly to a production of tapered bent tube with a consistent thickness and tapering.

Conventionally, a brass musical instrument with a bent tube of different calibers, such as Saxophone, Bass Clarinet, etc., has a bent tube portion, one end of said bent tube portion has a larger caliber while the other end has a smaller caliber; because of the special shapes of tapered bent tubes, in a conventional production, two brass plates are respectively punched and pressed to form the shape of two matching semi-taper bent tubes (a), (a'), then the two semi-taper bent tubes (a), (a') are combined, then its seam is welded to form, as shown in FIG. 6, and since the two components are assembled, there will be two welded seams on its outside, and though the welded seams can be eliminated in a polishing process, the trace will show, so its outside appearance will look coarse and unrefined, which will affect its integred appearance; but the final objective of a musical instrument is perfect sound effect, then the sound effect produced from the tapered bent tube that is composed of two halves of tapered bent tubes a,a' will be unsatisfactory.

Or, a single sheet of brass plate may be rolled to become a tapered tube, then it is bent to become a bent shape, then it is placed inside a mold hole with a tapered bent tube, then it is expanded to form by hydraulic approach; during the bending process of the straight tapered tube, there will be wrinkled folds at the bend, though the wrinkled folds may be eliminated in the expansion process, all the wrinkled folds cannot be eliminated, therefore, its outside appearance looks primitive.

During the expansion process, the expansion ratio on the outside of the tapered bent tube will be larger than that on the inside, as a result, the wall thickness on the outside will be thicker than that on the inside of the tapered bent tube, as a result, the wall thickness of the tapered bent tube will be inconsistent; there will be cracks due to the excessively high expansion ratio on the outside of the tapered bent tube, the final product will be defective; sound is produced from resonance of air flow in the tube of a brass musical instrument, but the resonance will be inconsistent because the thickness on the wall of a tapered bent tube is inconsistent, there will be mutual interference and subsequent noises to affect its sound quality.

Because the inconsistent wall thickness of a conventional product will affect the sound quality of the brass musical instrument, the inventor has devoted in the research and has designed a way of production for tapered bent tube with consistent thickness, whereby a primary mold is used to punch a brass plate to form a U-cup with a full opening, the two ends of the full opening of said U-cup being different calibers, the U-cup is then subjected to tempering treatment to eliminate its processing stress; then, an assembly forming mold is used to punch the full opening of the U-cup to form a rough shape of tapered bent tube with two ends of different calibers, and between the two different calibers is the formation of a flattened part; then, the flattened part on the rough shape of tapered bent tube is removed to form a tapered bent tube; the seam on the tapered bent tube is welded and smoothed by rolling, to complete the two ends with different calibers; in said production, the primary mold forms the outside portion of the tapered bent tube by expansion, then the assembly forming mold forms the inside portion of tapered bent tube by the same expansion approach, therefore, the inside and outside of the tapered bent tube will have approximated expansion ratios, to avoid the occurrence of cracks, to produce a tapered bent tube with a consistent thickness, and to obtain a better sound quality.

SUMMARY OF THE INVENTION

The objective of the present invention is to present a production approach for a brass musical instrument with a tapered bent tube, to the effect that the inside and outside of the tapered bent tube may have approximated expansion ratios, for the production of a tapered bent tube with a consistent thickness, thus avoiding the appearance of cracks or folded wrinkles, while a better appearance may be obtained.

To enable better understanding of the invention, the following drawings are described in details:

DETAILED DESCRIPTION OF PREFERRED EMBODIMENT

Figure 1:
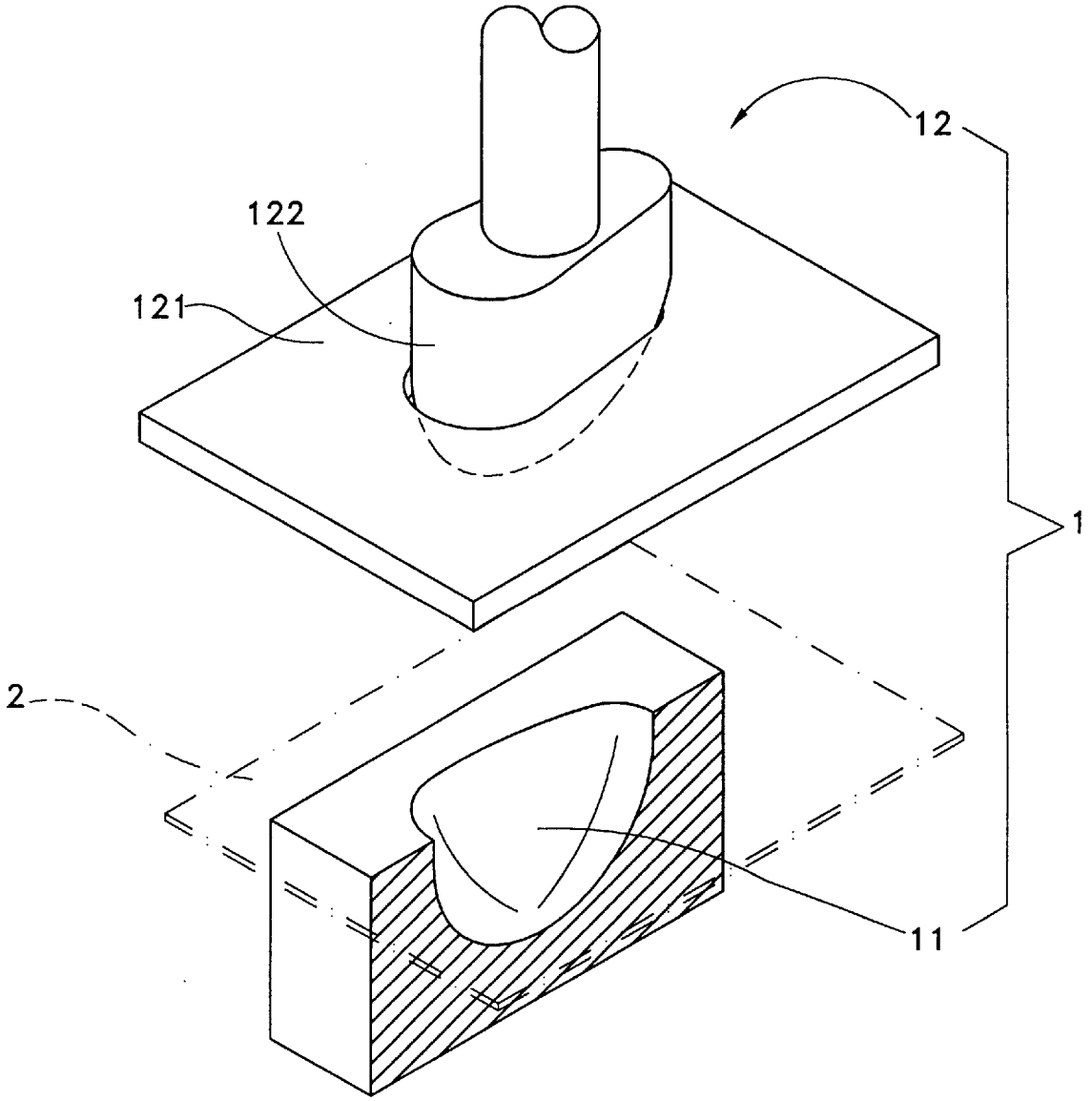
FIG. 1 is a perspective view of the invention.
Figure 2:
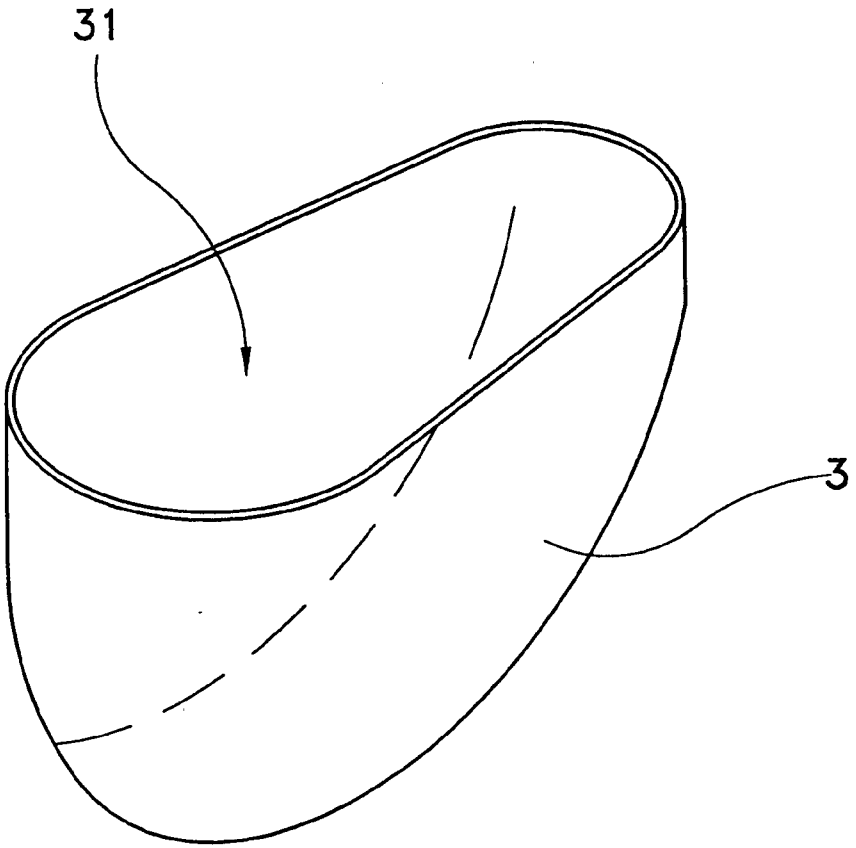
FIG. 2 is a perspective view of a U-cup in the invention.

Please refer to FIGS. 1, 2, 3 and 4, the present invention of a production of tapered bent tube involving mainly:

(a) a U-cup 3 with a full opening 31, that is punched from a brass plate 2 with primary mold 1, the two ends of the U-cup 3 with a fill opening 31 being 4 different diameters, as shown in FIGS. 1 and 2.

(b) The U-cup is subjected to tempering treatment, to eliminate its processing stress.

Figure 3:
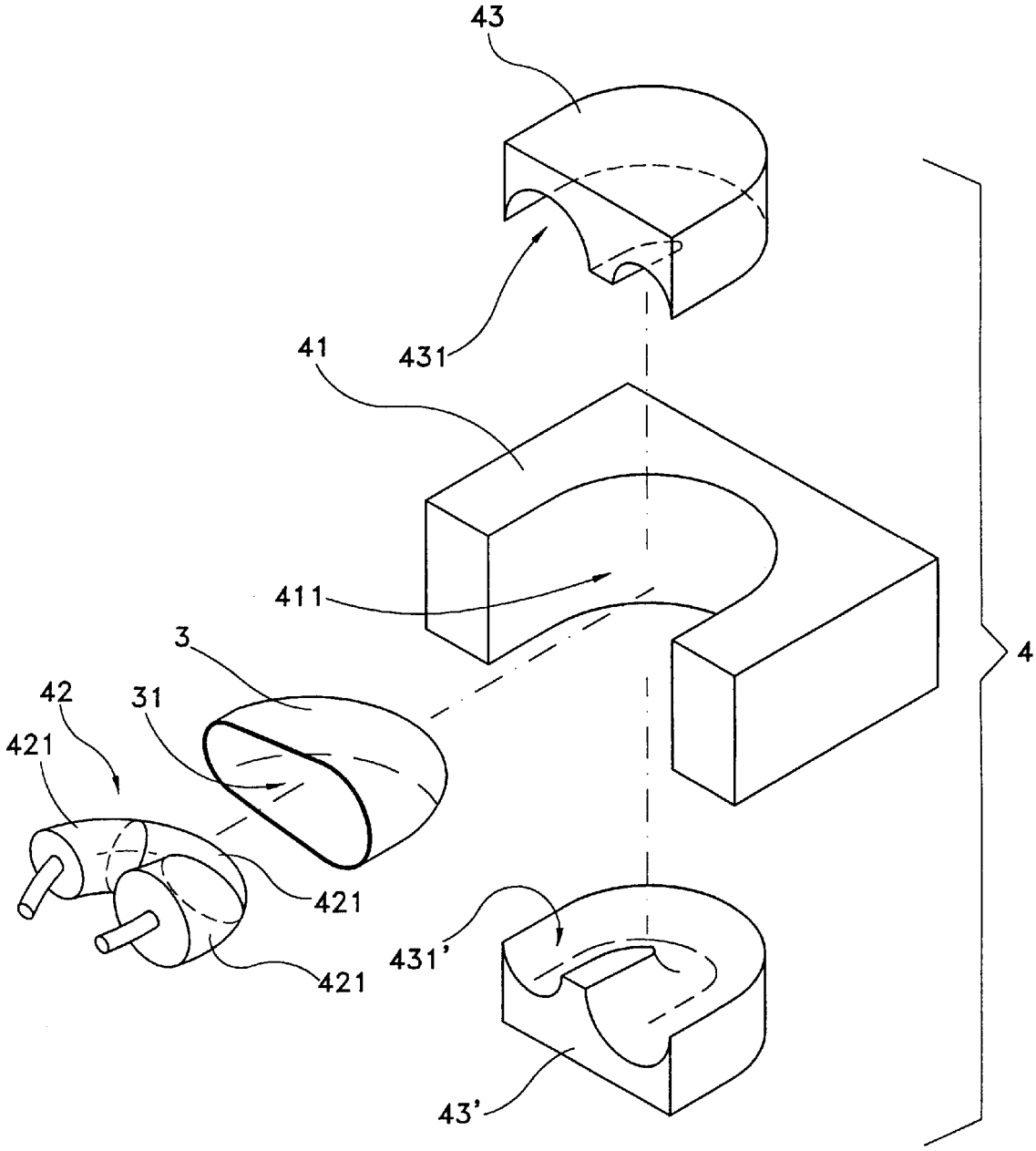
FIG. 3 is an exploded view of an assembly forming mold in the invention.
Figure 4:
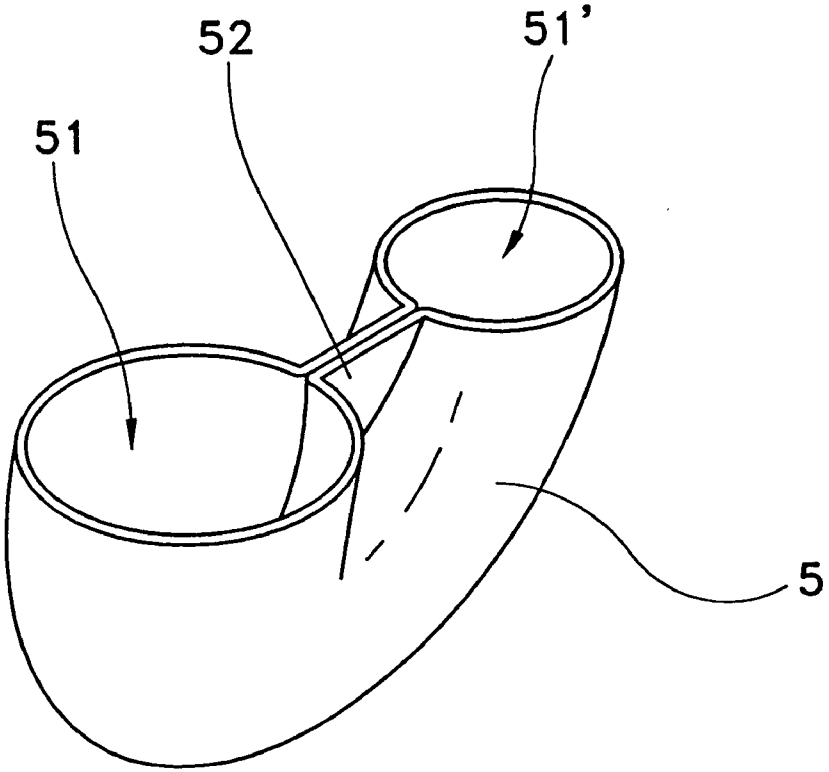
FIG. 4 is a perspective view of a rough shape of tapered bent tube in the invention.

(c) The two ends of full opening 31 of the U-cup 3 are then pressed in an assembly forming mold 4 to become a rough shape of tapered bent tube 5 with two different calibers 51,51', and between the two different calibers 51,51' is a flattened part 52, as shown in FIGS. 3 and 4.

Figure 5:
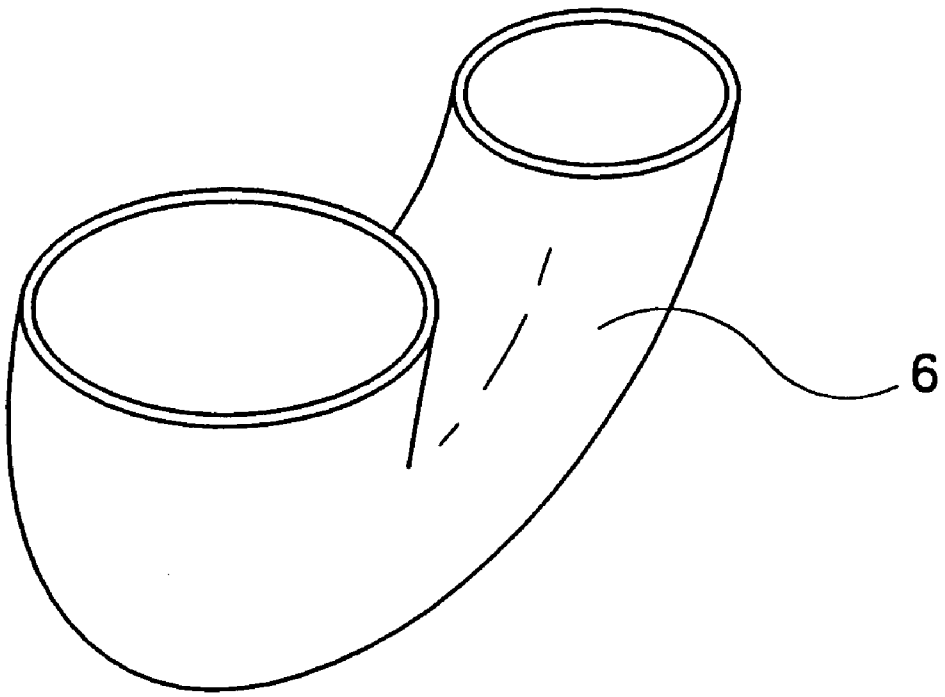
FIG. 5 is a perspective view of a finished product of tapered bent tube in the invention.
Figure 6:
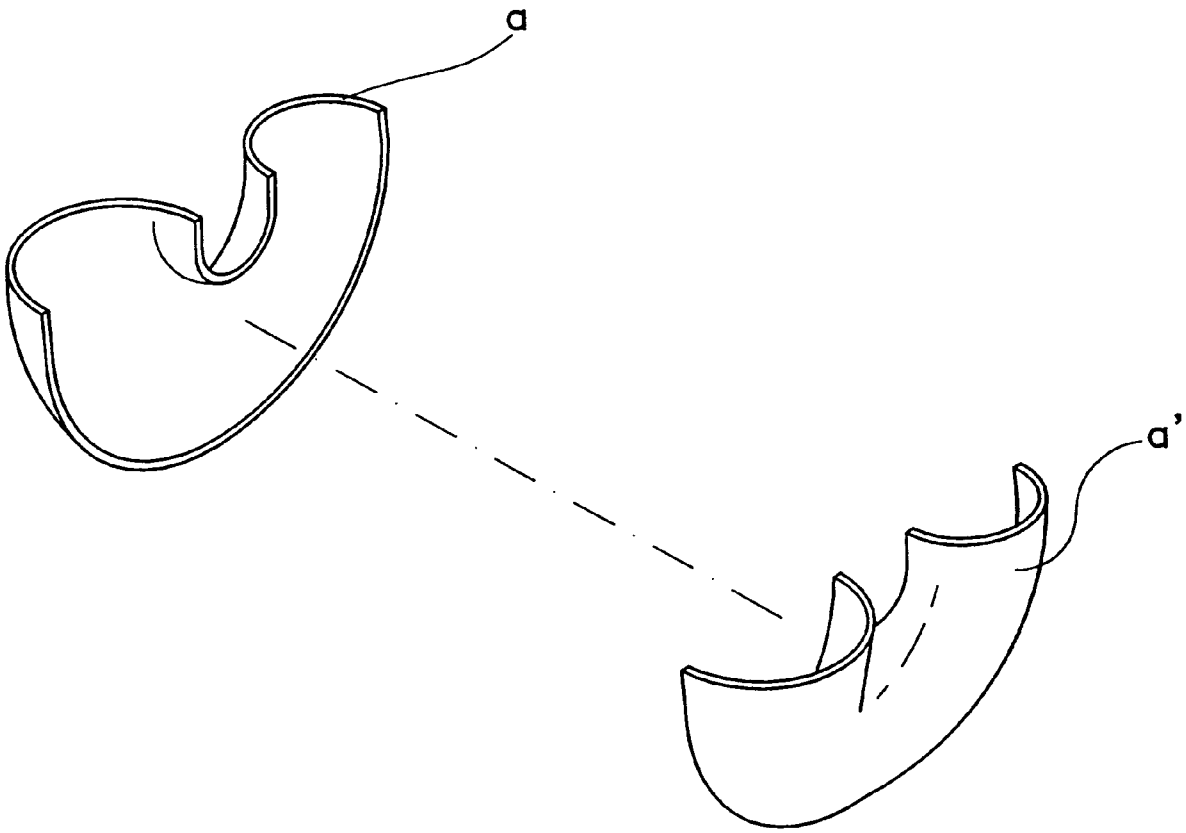
FIG. 6 (PRIOR ART)
FIG. 6 is an exploded view of a prior art of tapered bent tube.

(d) The flattened part 52 of the rough shape of tapered bent tube 5 is then removed, to form a tapered bent tube 6, as shown in FIG. 5.

(e) The seam of the tapered bent tube 6 is then welded before it is smoothened by rollers.

The aforementioned production, wherein, the primary mold 1 is composed of a female mold 11 and an assembly male mold 12, said female mold 11 having a full U-shaped mold hole 111, the two sides of the opening of said full U-shaped mold hole 111 being of different calibers, and said assembly male mold 12 involves a pressing plate 121 into which is inserted a punch head 122 that may move up and down and its shape corresponding to the shape of said full U-shaped mold hole 111, as shown in FIG. 1.

The aforementioned production, wherein, the assembly forming mold 4 is composed of a base mold 41, a bending assembly mold 42 and two pressing molds 43 that face each other up and down, on said base mold 41 is a U-opening 411;

said bending assembly mold 42 is composed of no less than three small bent molds 421 that are in serial connection, tapered and in arc arrangement, the outline of said bending assembly mold 42 corresponding to the U-opening 411 of the base mold 41, and can be mounted inside from the front of the U-opening 411; said pressing mold 43 and 43' are each a U-shaped plate, on its pressing side is a semi-tapered bent mold hole 431, 431', said two opposing pressing molds 43 and 43' may be pressed and mounted inside from the top and bottom sides of the U-opening 411 of the base mold 41, as shown in FIG. 3.

The aforementioned production, wherein, the brass plate 2 is placed between the female mold 11 and the assembly male mold 12 of the primary mold 1, when the assembly male mold 12 presses down, the pressing plate 121 of said assembly male mold 12 rest on the brass plate 2, then said punch head 122 punches down, and form the brass plate 2 as a U-cup 3; thus by means of the primary mold 1, the brass plate 2 is punched to form the exterior of a tapered bent tube 6 (or, the U-cup 3).

Then, the U-cup 3 is subjected to tempering treatment, to eliminate the processing stress of the U-cup 3; then, the U-cup 3 is placed in the U-opening 411 of the base mold 41 of the assembly forming mold 4, and the bending assembly mold 42 is mounted in the U-cup 3, the U-cup 3 is fixed in the U-opening 411 of the base mold 41, then the two matching pressing molds 43 and 43' rest on the top and bottom sides of the U-cup 3, to punch the U-cup into a rough shape of tapered bent tube 5 with two different calibers 51,51'; then the two pressing molds 43,43' and the bending assembly mold 42 retreat to the outside, and since the bending assembly mold 42 is composed of no less than three serially connected small bent molds 421, when the punching process is accomplished, said bent assembly mold 42 will be trapped inside the rough shape of tapered bent tube 5, then, the small bent mold 421 at two sides of outside will retreat to the outside, and the small bent mold 421 on the inside will be poured out from the end with a larger caliber 51, and the inside diameter of the small bent mold 421 'at the smaller caliber 51' is slightly larger than the outside, so when it retreats to the outside, the end with a smaller caliber 51' will flip outward slightly, without affecting the shape of the rough shape of tapered bent tube 5; therefore, the assembly forming mold 4 will press the U -cup 3 to a form the inside portion of the tapered bent tube 6 (i.e. the rough shape of tapered bent tube 5).

Finally, the flattened part 52 on the rough shape of tapered bent tube 5 is punched out, and the seam is welded and smoothed by rollers, to complete the tapered bent tube 6.

Since the outside and inside of the tapered bent tube 6 are respectively punched and formed by the primary mold 1 and the assembly forming mold 4, and the outside and inside of said tapered bent tube 6 are expanded to form, when the inside of the tapered bent tube 6 is formed, the outside portion of said tapered bent tube 6 will not be affected, therefore, the inside and outside of tapered bent tube 6 can have appropriative, if not identical, expansion ratios, and the integral tapered bent tube 6 may have a consistent wall thickness to obtain a better sound effect.

Since the expansion ratios of the inside and outside of the tapered bent tube 6 are appropriative or identical, there will be no cracks; since the inside and outside of the tapered bent tube 6 are individually punched to form by means of the primary mold 1 and the assembly forming mold 4, there will be no folded lines, and a better exterior appearance can thus be obtained.

What is claimed is:

1. A method for the production of a tapered bent tube, involving:

(a) a U-cup with a full opening, that is punched to form from a brass plate in a primary mold, the two ends of said full opening of said U-cup being of different calibers;

(b) said U-cup is then subjected to tempering treatment to eliminate its processing stress;

(c) said full opening of the U-cup is punched by an assembly forming mold to form a rough shape of tapered bent tube with two ends of different calibers, and between said two different calibers is a flattened part;

(d) said flattened part on said rough shape of the tapered bent tube is punched out to form a tapered bent tube; and (e) the seam of said tapered bent tube is welded and smoothed by rollers.

2. The method of production of a tapered bent tube as claimed in claim 1, wherein said primary mold is composed of a female mold and an assembly male mold, said female mold having a full U-shaped mold cavity, on the two sides of the opening of said full U-shaped mold cavity are different calibers, said assembly male mold involves a pressing plate on which is the insertion of a punch head that may move up and down and is so shaped to match the shape of said full U-shaped mold cavity.

3. The method of production of a tapered bent tube, as claimed in claim 1, wherein the assembly forming mold is composed of a base mold, a bending assembly mold and two pressing molds that face each other up and down, said base mold has a U-opening; said bending assembly mold is composed of no less than three small bent molds that are in serial connection, tapered and in arch arrangement, the exterior of said bending assembly mold is so configured to match said U-opening of said base mold, and it can be mounted in from the front of said U-opening; said pressing mold is a U-shaped plate, on its pressing side is a semi-taper bent tube mold hole, and said two opposite pressing molds may be inserted to said U-opening of said base mold from top and bottom sides.

* * * * *